United States Patent [19]

Greiner et al.

[11] 4,210,078

[45] Jul. 1, 1980

[54] APPARATUS FOR USE ON PRINTING PRESSES TO INSURE OPTIMUM COLOR DENSITY AND TO ASSIST IN MAKING CORRECTIVE ADJUSTMENT

[75] Inventors: Harry Greiner, Offenbach; Friedrich Preuss, Sprendlingen, both of Fed. Rep. of Germany

[73] Assignee: M.A.N.-ROLAND Druckmaschinen Aktiengesellschaft, Fed. Rep. of Germany

[21] Appl. No.: 16,324

[22] Filed: Feb. 27, 1979

Related U.S. Application Data

[63] Continuation-in-part of Ser. No. 856,271, Dec. 1, 1977, abandoned, which is a continuation-in-part of Ser. No. 608,190, Aug. 27, 1975, abandoned, which is a continuation-in-part of Ser. No. 589,948, Jun. 24, 1975, abandoned.

[30] Foreign Application Priority Data

Jun. 24, 1974 [DE] Fed. Rep. of Germany ..... 2430212

[51] Int. Cl.[2] ..... B41F 21/08

[52] U.S. Cl. ..... 101/136; 101/183; 101/240; 101/349; 209/581; 250/559

[58] Field of Search ..... 101/240, 232, 136, 237, 101/238, 239, 241, 177, 183, 184, 349, 350, 365, 233, 137, DIG. 24; 209/581, 582, 563, 576, 577, 3.2; 250/559, 562, 563, 571, 572; 356/429, 430

[56] References Cited

U.S. PATENT DOCUMENTS

| | | | |
|---|---|---|---|
| 2,969,016 | 1/1961 | Grosfield et al. | 101/350 X |
| 3,023,900 | 3/1962 | Their | 250/236 X |
| 3,138,048 | 6/1964 | Warren | 209/563 X |
| 3,286,567 | 11/1966 | Wright | 250/563 X |
| 3,386,575 | 6/1968 | Quinn | 209/564 X |
| 3,477,710 | 11/1969 | Koch et al. | 271/218 X |
| 3,734,630 | 5/1973 | McIntosh et al. | 250/556 |
| 3,748,046 | 7/1973 | Murray | 101/350 |
| 3,835,777 | 9/1974 | Krygeris | 101/365 |
| 3,866,054 | 2/1975 | Wolf | 250/562 |
| 3,930,447 | 1/1976 | Murray | 101/365 |

*Primary Examiner*—J. Reed Fisher

*Attorney, Agent, or Firm*—Leydig, Voit, Osann, Mayer & Holt

[57] ABSTRACT

A mechanism for sorting sheets from a printing press to assure proper color density and to assist in making corrective adjustment which includes a main conveyor for normally conducting sheets to a main delivery pile and having a transfer station. An auxiliary conveyor extends from the transfer station to an auxiliary delivery pile. A scanning device is arranged upstream of the main conveyor for responding to the color density of the printed image on a passing sheet. A comparator produces a control signal when the color density is above or below tolerance, signifying a sub-quality sheet. Mechanism at the transfer station is triggered by the control signal so that the sub-quality sheet is diverted to the auxiliary conveyor for depositing on the auxiliary pile. The mechanism not only accomplishes sorting but the fact of diversion and the observed rate of diversion provides constant instruction to the pressman as to the necessity for, and the degree of, a corrective change in ink feed rate.

1 Claim, 3 Drawing Figures

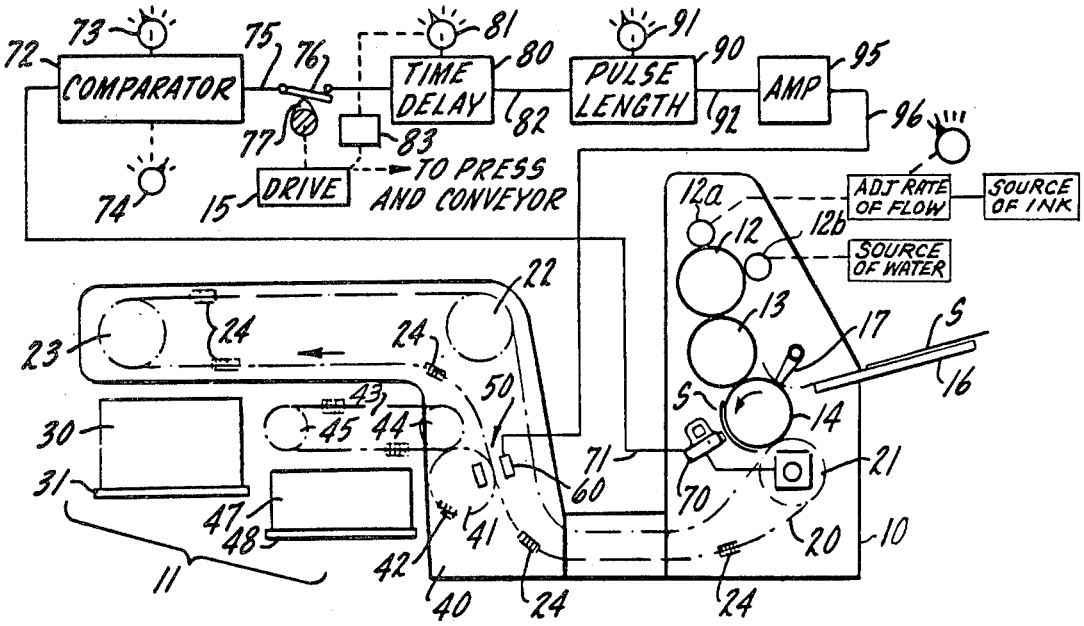
fig. 1.
fig. 2.
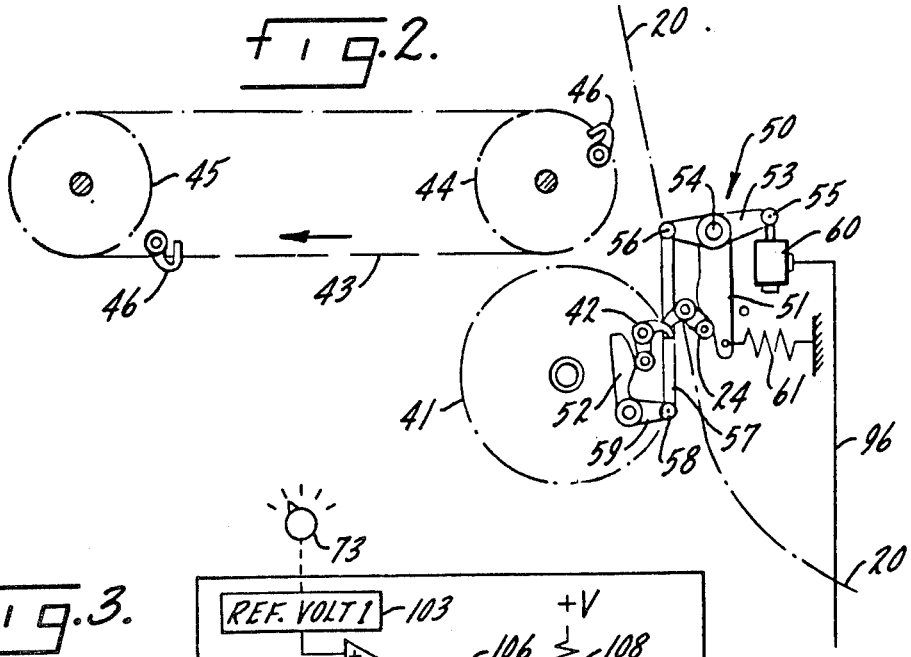
fig. 3.
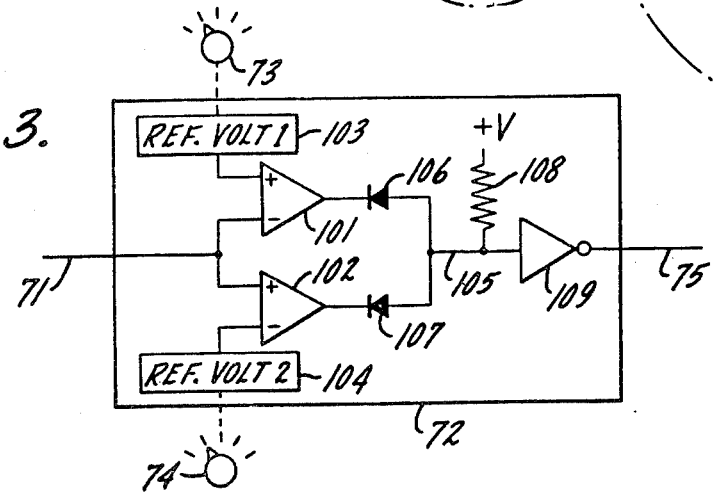

APPARATUS FOR USE ON PRINTING PRESSES TO INSURE OPTIMUM COLOR DENSITY AND TO ASSIST IN MAKING CORRECTIVE ADJUSTMENT

This is a continuation-in-part of application Ser. No. 856,271 filed Dec. 1, 1977, which is a continuation-in-part of application Ser. No. 608,190 filed Aug. 27, 1975, which is a continuation-in-part of application Ser. No. 589,948 filed June 24, 1975, all now abandoned.

The present invention has to do with a control system for a printing press which enables a significant change in press room procedures. In the past it has been necessary for an operator to exercise a high degree of experience and skill in order to increase the likelihood that each printed sheet going to a customer will be of highest quality. It has been necessary for adjustments to be made with great expertise, particularly changes in ink feed rate, water feed rate and press operating speed, all of which have an effect upon the quality of the printed image.

To have a basis for corrective adjustment, it has been necessary for the pressman to monitor the stream of printed copies. This cannot be done with the sheets in motion so it has been necessary to periodically retrieve copies, a basically unsatisfactory procedure. For example, a sheet may be manually retrieved as it is being deposited upon the delivery pile. Printed sheets are fed to the pile in quick succession and it is necessary to use speed and dexterity to avoid interference with a following sheet with risk of spoiling the pile. The retrieved sheets are usually wasted and sheets known to be bad, but delivered to the pile, are marked, or slipped, for later removal. It is impractical to "spot check" often enough to insure that unmarked sheets, deposited on the delivery pile, are all of high quality.

To make retrieval for "proof" or sampling purposes easier, diverter mechanisms have been used as taught in commonly-owned Koch et al. U.S. Pat. No. 3,477,710. The diverter mechanism in Koch et al. is manually operated and, while making the above manual retrieval unnecessary, presents an operating dilemma, even in the hands of a highly skilled press operator. Such a mechanism is normally employed to receive the sheets, known to be defective, and which are produced under conditions of start-up or where there is an abrupt change in speed, rate of ink or water feed or other operating condition. The auxiliary pile of sheets is, therefore, defective by definition. When, during the operation of the press, the diverter mechanism is employed for proof or sampling purposes, "good" sheets will be deposited in the defective pile. Where the press operator is conscientious and diverts samples at frequent intervals, the defective pile will include an increased number of good sheets which are either wasted or which must be laboriously extricated at the completion of the printing run. Thus even the most skilled operation of the Koch et al. mechanism cannot insure against the loss of good copies in the defective pile nor insure against depositing, in the main pile, occasional copies which are poor and unacceptable by reason of being either too light or too dense.

Even where the position of a defective sheet in the main delivery pile is known, having been marked by a slip of colored paper or the like, retrieval of the sheet is exceedingly burdensome; one can well appreciate the difficulty of getting a defective sheet out from under a superimposed heavy stack. Moreover, retrieving the defective sheets runs serious risk of damaging the adjacent good sheets in the pile.

The Thier U.S. Pat. No. 3,023,900 shows a device which is intended for discovering pinholes or the like in a sheet. If a sheet has objectionable pinholes or clumps, it is diverted from the stream. The Thier device has nothing to do with printing, is inherently incapable of solving the problems arising in the field of printing, and would have to be completely redesigned and rebuilt in order to be at all useful in the printing field. By way of example, it is to be noted that the present device includes, and depends upon, a "comparator" which has both upper and lower reference devices for respectively producing a control signal at the output terminal when the color density signal is either above or below a preset tolerance range. This is an idea which is not disclosed in Thier. For the Thier device to be analogous to the present invention Thier would logically have to teach acceptance of sheets having an optimum number or size or pinholes while diverting, into the same rejection pile, all sheets having either too many pinholes or too few pinholes. In fact, the latter is not taught in Thier nor in any other patent known to the applicants. Equally noteworthy is the fact that Thier fails to teach a feature which is central to the present system: the continuous monitoring of the current result of an ongoing process, with only the successful result of that process (perfect sheets) being delivered and with the unsuccessful result of that process (imperfect sheets) being diverted to provide instant instruction to the operator as to the making (both in direction and degree) of a corrective change.

Turning next to the Krygeris U.S. Pat. No. 3,835,777, it suffices to say that the applicants here have flown in the face of Krygeris. The patent teaches the making of a density observation and then causing the resulting output signal to make an automatic corrective change in ink feed. This sounds like a logical solution, but applicants have found that such automatic systems are inherently inoperative. The problem in such a "closed loop" control device is that changes in ink feed rate do not, and cannot, take place immediately at the plate. Thus when an overly dense copy is noted, resulting in the cutting down of the ink feed rate, sufficient ink is stored in the transfer rollers so that subsequent copies tend to be equally dense, and equally defective, unitl the corrective effect finally makes itself felt. Such defective interim copies are, of course, deposited in the delivery pile along with the good ones and must be laboriously identified and retrieved in the usual way. An analogous situation exists when an overly "light" copy is detected.

The approach of the present applicants has been just the opposite: applicants avoid making any correction of the ink feed or other operating conditions in direct and automatic response to a density reading. The making of such correction is only done manually, with the defective interim sheets being diverted. In the present device depositing of overly dense or "light"sheets in the auxiliary pile, in addition to disposing of substandard copies, serves to alert the pressman, be he skilled or unskilled, that a change in the operating conditions is called for. Simple inspection of a diverted sheet provides an infallible indication of the direction of the corrective change which is required. The rate that sheets are being diverted indicates the degree of the change. The ink feed adjustment is changed accordingly, until sheets stop being deposited in the auxiliary pile.

The applicant's contribution is based upon recognition that any press will produce defective copies, copies which are either too dense or too light, regardless of the skill of the operator. Copies in both of these categories are automatically discarded in the same auxiliary pile. The end result is that (a) the number of defective (discarded) copies is minimized and (b) the customer receives only perfect copies since only perfect copies are deposited in the main pile. There is no need for either manually identifying a sub-quality copy or for laboriously retrieving it from the pile.

The present system not only insures that the customer will receive only perfect copies, but the pressman is freed from the burden of even having to decide between a good copy and a sub-quality copy. He can devote all of his energy and attention to the making of touch-up adjustments with a single aim in mind, minimizing the rate at which copies are deposited in the auxiliary pile. The rate at which such copies are deposited, and the reduction in such rate, provides a direct gauge by which an inexperienced press operator can demonstrate, to himself and others, improvement in his operating skill.

It is a primary object of the present invention to provide a system for assisting an operator to properly adjust the manual controls of a printing press in order to obtain the highest yield of printed copies while at the same time assuring that only perfect copies are accumulated for sending to the customer, regardless of the level of skill of the pressman.

It is a more particular object to provide a system for insuring optimum color density in a printed and delivered product and in which delivery of sheets to an auxiliary pile indicates necessity for the making of a corrective adjustment of printing density, with the rate of such delivery indicating the amount of corrective adjustment which is required.

It is a related object to provide a sorter mechanism for automatically sorting sheets produced by a printing press in accordance with a quality measurement and in which the range of quality tolerance is precisely settable at adjustable upper and lower limits to provide precise demarcation between sheets of acceptable quality and sheets which are unacceptable, with the latter being nevertheless recovered, without handling, for possible sale as second grade. It is a more detailed object to provide means for accumulating sub-quality sheets without necessity for retrieving them from the main delivery pile, with the work that that entails; on the contrary, the sub-quality sheets are accumulated in a precisely formed pile free of damage caused by manual retrieval.

It is yet another object of the present invention to provide automatic high speed means for judging the quality of printed sheets on a continuous and automatic basis and for diverting onto an auxiliary pile sub-quality sheets in accordance with accurately established criteria, without necessity for the operator of the press to "sample" sheets for inspection during the course of the run or to retrieve sub-quality sheets, either upon start-up or upon making an abrupt change in the speed of the press.

Other objects and advantages of the invention will become apparent upon reading the attached detailed description and upon reference to the drawings in which:

FIG. 1 is an elevational diagrammatic side view of a press unit and associated conveying and delivery mechanism and with the control circuitry set forth in block form;

FIG. 2 is a diagrammatic enlargement of the transfer station and auxiliary conveyor shown in FIG. 1;

FIG. 3 is a typical comparator which may be employed in the present invention.

While the invention has been described in connection with a preferred embodiment, it will be understood that we do not intend to be limited to the particular embodiment shown but intend, on the contrary, to cover the various forms of the invention which are included within the spirit and scope of the appended claims.

Turning now to FIG. 1 of the drawings there is disclosed a printing press unit 10 and a conveying and delivery mechanism 11. The printing unit includes a plate cylinder 12, a blanket cylinder 13 and an impression cylinder 14. Ink and water are applied to the plate on the plate cylinder by respective form rollers **12*a*, 12*b* fed from adjustable sources, the means for manually adjusting the ink flow rate, and hence the density of the printed product, being per se old and well known and therefore only diagrammatically shown. In general, a corrective change is made in the ink feed rate followed by a proportional touch-up change in water feed. The cylinders, as well as the conveyor mechanism to be described, are coupled to a drive mechanism diagrammatically illustrated at 15. A sheet S which is fed across a feed table 16 is engaged by a swing gripper 17 which transfers the sheet to conventional grippers (not shown) on the impression cylinder 14**.

The impression cylinder cooperates with a conveyor 20 which is trained about sprocket wheels 21, 22, 23 and which carries a series of grippers 24. The grippers 24, and the means for opening and closing them, will be understood to be conventional and have not been illustrated in detail. It will suffice to say that during the normal running of the press the grippers 24 grip sheets in succession, with the sheets being released above a main delivery pile 30 formed on a platform 31. Conventional lowering means (not shown) are provided for gradually lowering the platform 31 as the pile builds up.

In carrying out the invention there is provided on the "feed" side of the conveyor 20 a transfer station 40 including transfer mechanism and an auxiliary conveyor for conveying sheets from the transfer station to an auxiliary delivery pile. Thus at the transfer station 40 there is provided a transfer drum 41 having a gripper 42 and an associated auxiliary conveyor 43 trained about sprockets 44, 45 and having grippers 46 for discharging sheets upon an auxiliary pile 47 supported upon a platform 48.

Transfer mechanism for operating the grippers 24, 42 is indicated at 50 in FIG. 2. Such mechanism includes a first cam 51 interposable in the path of movement of grippers 24 on the main conveyor and a second cam 52 interposable in the path of gripper 42 on the transfer drum. A linkage is provided for alternatively interposing the cams 51, 52 to establish transferring and non-transferring modes. Such linkage includes a rocking lever 53 mounted on shaft 54 and having first and second points of connection 55, 56. Pinned to the latter is a drop link 57 having a point of connection 58 at its lower end to the lever 59 of dog-leg shape. For operating the lever 53 a power actuator 60 is provided which may, for example, be in the form of a solenoid working against a return spring 61. The transfer mechanism 50 is illustrated in the actuated "transfer" mode, with the solenoid 60 being sucked in and with the rocking lever 53 in its clockwise-rocked position, the return spring being in the stressed or extended state. Under such conditions the cam 51 is interposed in the path of movement of the gripper 24 so that such gripper is opened as it reaches the transfer station, thereby releasing the gripped sheet. The second cam is, however, rocked by the drop link 57 counterclockwise into its retracted, or silenced, position in which it is clear of the gripper 42 so that such gripper is free to close upon the sheet released from gripper 24. It will be understood that the gripper 42 has the usual means for causing the gripper to close at the transfer station free of the influence of the cam 52.

As a result the sheet is transferred from the main conveyor 20 onto the transfer drum 41 from which the sheet is picked up by one of the grippers 46 on the auxiliary conveyor 43. The auxiliary conveyor, it will be understood, includes conventional means (not shown) for triggering release of the sheet above the auxiliary delivery pile 47.

When the actuator 60 is de-energized, accompanied by contraction of the return spring 61 and counterclockwise rotation of the rocking lever 53, the functions of the two cams 51, 52 are, in effect, interchanged. That is, the cam 51 is rotated into a retracted or silenced condition in which it held clear of the grippers 24 on the main conveyor so that such grippers are able to traverse the transfer station without opening, that is, without releasing the sheets which they respectively carry. However, counterclockwise rocking movement of the lever 53 thrusts the drop link 57 downwardly, thereby rotating the lever 59 clockwise to bring the cam 52 thereon into the path of movement of the gripper 42 on the transfer drum. This disables the gripper 42, holding it open, as the gripper passes the point of transfer so that the gripper on the drum is incapable of receiving the sheet passing on the main conveyor. The sheet therefore continues travelling on the conveyor until the gripper reaches a point above the main delivery pile 30 where the sheet is released, by conventional means (not shown), upon the top of the pile.

While the transfer mechanism 50 has been shown and described only in rudimentary form for the sake of simplicity, cross reference is made to the above-mentioned U.S. Koch et al. patent for further descriptive details.

In accordance with the present invention a color density scanning device is arranged upstream of the main conveyor for scanning the printed image on each passing sheet and for producing a color density signal in accordance with the color density of the image. When the color density signal is outside of an established tolerance range, a control signal is produced signifying a sub-quality sheet, which temporarily energizes the actuator to place the transfer mechanism 50 in its illustrated transfer mode so that the sub-quality sheet is transferred to the auxiliary conveyor for depositing upon the auxiliary pile 47.

Thus referring to FIG. 1 a color density scanning device 70 is mounted on the press frame in a position to scan the printed image upon the sheet S carried by the impression cylinder 14. The output, in the form of a color density signal, is applied to the line 71. Color density scanning devices, producing an output which varies in accordance with color density, are staple devices available on the market and a detailed description is therefore unnecessary. For the purpose of determining whether the color density signal is within tolerance, a "comparator" 72 is used having controls 73, 74 for adjusting the upper and lower tolerance limits. Reference will be made hereafter to a typical circuit which may be utilized in the comparator, but it will suffice for the present to say that when the color density signal is within set limits no signal appears at the output terminal 75 of the comparator. In other words as long as the printed product is within the acceptable range of color density, so that no control signal is produced, the actuator 60 remains unenergized for normal flow of sheets to the main delivery pile 30. However, in the event that the color density signal is above or below the set range, a control signal appears at output line 75 to trigger the transfer mechanism.

To insure that a control signal will be produced only incident to scanning of the printed area on the sheet, a sampler switch 76 is preferably provided driven by a cam 77 which is coupled to the drive 15 of the press. Such cam may, for example, be mounted upon the shaft of, or synchronized with, the impression cylinder 14 so that the switch is turned on during the time that the scanning device 70 is scanning the central portion of the printed image.

In accordance with one of the aspects of the present invention a time delay device 80 is interposed in the circuit having an adjustable time delay control 81 and an output line 82. It will be understood that the amount of time delay for which the control 81 is adjusted is equal to substantially the time required for the sheet S being scanned by the device 70 to reach the transfer station 40. The time delay device is preferably controllingly coupled to the press drive via a speed responsive device 83 so that the time delay, once set, is thereafter inversely proportional to conveyor speed. If desired, a pulse length control 90 may be provided having a control 91 and an output line 92 to control the length the output pulse, upon triggering by an input pulse, thereby giving additional assurance that the actuator 60 will remain energized for a sufficient time for transfer to take place. The control signal is, finally, amplified by an amplifier 95 capable of power output sufficient to energize the solenoid actuator 60 via an output line 96.

Referring more specifically to the comparator 72, the circuit of which is shown in FIG. 3, it will be seen that it includes a pair of differential amplifiers 101, 102 having sources of reference voltage 103, 104 settable by controls 73, 74, respectively. The outputs of the differential amplifiers are connected in parallel to an output line 105 via diodes 106, 107 which are interposed for purposes of isolation. The output line is at a normally high voltage fed from a suitable source v through a dropping resistor 108. To provide an output signal on line 75 when the color density signal is either above or below the range of tolerance, but with absence of signal when within tolerance, a conventional inverter 109 is used.

Thus when the color density signal on line 71 is greater than the reference voltage from source 103, the output of the differential amplifier 101 swings from high to low, dropping the potential at the left-hand side of the diode 106 so that current is drawn through the resistor 108. This drops the input voltage at the inverter 109 producing a control voltage on the comparator output line 75.

Similarly when the voltage on the input line 71 is less than the reference voltage from source 104, as set by control 74, the output of the differential amplifier 102 swings from high to low thereby dropping the potential at the left-hand side of diode 107 causing current to be drawn through the resistor 108. This also drops the potential at the input terminal of the inverter 109 resulting in application of control voltage to the output line 75. Thus it is seen that either a "high" color density signal or a "low" color density signal is effective to produce a control signal on the line 75 to operate the transfer mechanism 50.

However, where the level of the control signal is between the values set on controls 73, 74, both amplifiers 101, 102 produce high voltage output so that no current is drawn through resistor 108 causing the voltage at the input of the inverter to be high resulting in zero control signal at the output of the comparator, so that with acceptable color density, the actuator 60 remains de-energized and copies flow uninterruptedly and in normal fashion to the main delivery pile 30.

It will be apparent that variations may be incorporated into the system without departing from the invention. The color density scanning device 70, for example, is preferably oriented in a radial position with respect to the impression cylinder 14 and is preferably mounted for transverse adjusting movement so as to scan a selected narrow ribbon of printed area. However, it is not necessary that the scanning device cooperate with the impression cylinder and such scanning device may be located at any point sufficiently "upstream" with respect to the conveyor 20 so as to provide time for the transfer mechanism to set the cams 51, 52. Thus the term "upstream" shall be considered to include any location ahead of the conveyor or in the upstream portion of conveyor movement. Where the distance between the scanning device and the transfer mechanism is less than the distance between adjacent grippers 24, a simple form of time delay device may be used, or the pulse may simply be delayed by elongation until the scanned sheet reaches the transfer station. However, as in the present embodiment, where the grippers 24 are more closely spaced, the time delay device 80 should be capable of producing an output pulse a predetermined interval after any input pulse even though the pulses may "overlap." While a delay device 80 of electronic type may be used, with means 83 for proportioning the delay to the speed of the conveyor, it will be apparent that the invention is not limited thereto and the invention includes use of time delay means responsive to conveyor movement, with distance traversed from scanner to transferring station being the criterion, rather than time as such, so that the delay is self-proportioned to conveyor speed. The important thing, as far as the invention is concerned, is that each sheet is scanned and that a control signal corresponding to that particular sheet is applied to the transfer mechanism at a time when that sheet approaches the transfer station.

In the present embodiment the actuator 60, which drives the transfer mechanism, must be powered to place the mechanism in the transfer mode. It will be apparent, however, that it is not essential that this be so in order to practice the invention and that the positions of the actuator and return spring may, if desired, be interchanged so as to make the mechanism 50 normally-transferring. If this is done, then the inverter 109 in the comparator will not be necessary and can be omitted. This will, however, require that a normally closed rather than a normally open type of cam switch be used. It is clear from this that the term "control signal" is not to be limited to a condition of energization, but may in fact be the absence of energization, as long as such signal results in transfer of the sub-quality sheet.

In carrying out the invention it is considered undesirable to scan the marginal areas at the leading and trailing edges or to scan the gaps between the leading and trailing edges. Use of the sampling switch 76 causes a control signal to be produced only during, and incident to, scanning of the printed image. If desired, means may be provided for adjusting the active arc of the cam switch 76, 77 to vary the length of the scanned "ribbon" on each sheet. Keeping in mind that the purpose of the sampling device is to make the scanner exclusively responsive to useful information on the sheet, indicative of printing quality, it will be apparent to one skilled in the art that the sampling means may be located, if desired, in any portion of the circuit as long as it is capable of "enabling" the circuit at significant times synchronized with passage of the printed area.

The purpose of the scanning device in the present instance is to read color density as a criterion of quality. By color density is meant the density of the ink on the sheet, which should neither be too light nor too dark, regardless of whether the printing is done in a single color or in multiple colors. However, the invention in its broadest aspect is not limited to the measurement of color density, and any appropriate scanning device may be employed capable of producing a reading which varies in accordance with the quality of the printed product, regardless of the quality criterion which is selected. Consequently, the term "quality signal" as used herein refers to a signal, existing on line 71, which is proportional to color density or analogous quality criteria.

When the system is used, as illustrated, with an operating press, the system brings about a major change in adjustment criteria and procedures, in economies of operation and in the assured quality of the delivered product. The system not only insures delivery and furnishing to the customer of perfect copies, even with an operator lacking skill and experience, but the system assists the operator in acquiring skill and reducing the number of copies in the auxiliary pile in at least two ways. In the first place inspection of the copies being deposited on the auxiliary pile, depending upon whether they are too light or too dark, immediately instructs the pressman as to the direction of the corrective change in ink flow rate: if a delivered copy is noted as being too light the ink feed is adjusted in the direction of increased rate, and vice versa. Secondly, with regard to the amount of corrective adjustment, this may be gauged in accordance with the noted rate of diversion. Thus if only an occasional sheet is being diverted, showing detection to be at the threshold level, only a slight change in ink rate will suffice. But if many or all of the sheets are being diverted, a prompt step change in the feed rate adjustment is called for, the aim in both cases being to bring about zero diversion promptly, just as soon as the reservoir effect of the transfer rollers has been dissipated. A "feel" for this is quickly and progressively developed, even by the most unskilled pressman. Cessation of the delivery of copies to the auxiliary pile indicates to the pressman that the ink flow rate is optimum for production of perfect copies and that no change is therefore required. There will be sheets, discarded sheets, in the auxiliary pile when a press run is in progress or has been completed, even where the operator is highly skilled, because of the defective copies produced on start-up, etc. Where the operator is unskilled there will be a greater number of copies in the auxiliary pile. This has dual significance. In the first place, regardless of the level of skill, only perfect copies are delivered to the main pile for delivery to the customer and without laborious sampling, locating, marking and retrieval. Secondly, the number of copies in the auxiliary pile at each point in the run, in addition to providing criteria for corrective adjustment, serves as a constant and objective indicator, both to the pressman and his employer, of his progress in acquiring productive skills.

What is claimed is:

1. In an apparatus for use on printing presses having means for varying rate of ink flow to insure optimum color density and to assist in making corrective adjustment, the combination comprising means for continuously feeding sheets from a press, means defining a main delivery pile and an auxiliary delivery pile, means including a main conveyor having grippers thereon and a feed side for normally conveying the sheets along the feed side from the source to the main delivery pile for depositing thereon, the main conveyor having a transfer station at the feed side, means including an auxiliary conveyor having grippers thereon for conveying sheets from the transfer station to the auxiliary delivery pile for depositing thereon, a transfer mechanism at the transfer station for operating the grippers at the transfer station in (1) a normal mode in which a sheet is delivered to the main delivery pile and (2) a transfer mode in which the grippers at the transfer station transfer the sheet to the auxiliary conveyor for depositing on the auxiliary delivery pile, a power actuator for shifting the transfer mechanism from the normal mode to the transfer mode, means including a scanning device arranged upstream from the transfer station for scanning the printed image on each passing sheet and for producing a color density output signal which varies in accordance with the color density of the printed image on the sheet, a comparator having an input terminal connected to the scanning device and having an output terminal, the comparator having upper and lower reference devices coupled to the input terminal and having unlike reference settings to define between them a tolerance range, the comparator having means for (a) producing a control signal on the output terminal when the color density signal at the input terminal is above that for which the upper reference device is set thereby to identify a sub-quality sheet and for (b) producing a control signal on the output terminal when the color density signal at the input terminal is below that for which the lower reference device is set thereby to identify a sub-quality sheet while producing a null signal at the output terminal when the color density signal is within the tolerance range, the output terminal of the comparator being coupled to the actuator for triggering the same by the control signal, a time delay device effectively in series with the comparator for delaying the control signal thereby to delay the triggering of the power actuator until just prior to the arrival of the sub-quality sheet at the transfer station so that the sub-quality sheet is transferred to the auxiliary conveyor for deposit upon the auxiliary delivery pile, and means for adjusting the signal level of the reference devices in the comparator to vary the range of tolerance of the acceptable copies which are deposited upon the main delivery pile while copies both above and below this range are deposited together on the auxiliary delivery pile, the density condition and rate of deposit of sheets on the auxiliary pile giving constant instruction to the pressman as to the direction and degree of any corrective change required in rate of ink flow.

* * * * *